US006375532B1

(12) United States Patent
Eiband et al.

(10) Patent No.: US 6,375,532 B1
(45) Date of Patent: Apr. 23, 2002

(54) QUICK RELEASE SAFETY MECHANISM

(75) Inventors: David M. Eiband; Meredith K. Eiband, both of Ridgecrest, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/774,164

(22) Filed: Jan. 25, 2001

(51) Int. Cl.[7] ..... B63C 9/08
(52) U.S. Cl. ..... 441/88; 441/84
(58) Field of Search ..... 441/80, 84, 85, 441/88, 89; 119/794

(56) References Cited

U.S. PATENT DOCUMENTS

| | | | | |
|---|---|---|---|---|
| 4,262,865 A | | 4/1981 | Smith | |
| 4,337,913 A | | 7/1982 | Booth | |
| 4,428,102 A | | 1/1984 | Brownell | |
| 5,423,292 A | | 6/1995 | Hall | |
| 5,432,955 A | | 7/1995 | Plotka et al. | |
| 5,595,143 A | * | 1/1997 | Alberti | 119/794 |
| 6,042,440 A | | 3/2000 | Ettl | |

OTHER PUBLICATIONS

The American National Red Cross, The Rescue Tube, *Lifeguarding Today*, 1995, p. 105, Mosby Lifeline, St. Louis, MO, USA.

* cited by examiner

*Primary Examiner*—Jesus D. Sotelo
(74) *Attorney, Agent, or Firm*—Anthony J. Serventi

(57) ABSTRACT

A quick release safety mechanism for use with a rescue tube is described herein. A preferred embodiment of the present invention incorporates a buoyant support, a connection strap having a distal end and a proximate end, and a means for attaching the shoulder strap. A functional shoulder strap is formed by looping the distal end and attaching the distal end to the proximate end with a hook and loop fastener, such as Velcro®. Means for disengaging the hook and loop fastener provides a rescuer with the ability to quickly and easily eliminate the dangers associated with a failed rescue attempt. In a preferred embodiment of the present invention, the means for disengaging the hook and loop fastener is a toggle attached to the distal end of the shoulder strap. Other means for disengaging the hook and loop fastener include a nylon or cloth loop sewn into the distal end on the shoulder strap or the distal end sewn into itself producing a loop.

7 Claims, 3 Drawing Sheets

QUICK RELEASE SAFETY MECHANISM

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

BACKGROUND OF THE INVENTION

1. Field of the Invention

The present invention relates to the field of water retrieval devices and more particularly, to a release mechanism for a standard rescue tube. More particularly, the present invention assists a rescuer in protecting himself and the victim by the rescuer to disengage from a rescue attempt in the event of an error.

2. Description of the Related Art

The rescue tube is among the most used pieces of active/passive victim rescue equipment by aquatic professionals. It's versatility, ease of use, and softness have made it a popular choice in many waterparks in America. Several variations of the popular tube design can be used in different situations.

A typical rescue tube includes a floatation member, connected to a thick shoulder strap by several feet of strap material which allows a lifeguard to get the flotation member to an active victim struggling in the water even if that person is beyond the lifeguard's normal reach. The shoulder strap may be a loop of strap material that is large enough to fit around a lifeguard's head and one shoulder.

The rescue tube serves several purposes. A rescue tube provides flotation for a victim and a rescuer. A victim who can keep his or her mouth above water feels less anxiety during a rescue attempt and will more easily follow directions from a rescuer. A rescue tube reduces the energy required to transport a victim to a safe area. A rescue tube reduces the chance of a victim grasping a rescue during a rescue attempt.

Using the current procedures and rescue tube configuration, the rescuer is trained to always keep the tube between the rescuer and the victim. The problem arises when the victim, through mistake by the rescuer or over action by the victim, is able to move inside of the tube, to grab the strap, and then pull up the strap until the victim is in contact with the rescuer. In that situation, the rescuer cannot easily remove the strap loop from under his arm. As a result, the rescuer and the victim are at risk of drowning.

While numerous innovations for aquatic retrieval devices have been provided in the prior art none of these existing inventions, however, describes the design or concept of the present invention. Even though these innovations may be suitable for the specific individual purposes to which they address, they differ from the present invention.

U.S. Pat. No. 6,042,440 issued to Ettl on Mar. 28, 2000, incorporated herein by reference, describes a water rescue device, which discloses a slack eliminator. The slack eliminator mechanically coils any slack extension strap between the flotation member and the shoulder strap. The primary object of Patent '440 is to allow a rescuer to quickly leave a lifeguard stand without risk of a dangling rescue tube being hung up on surrounding objects. The '440 Patent does not involve an apparatus, which permits a rescuer to disengage from a victim during a rescue attempt.

Several types of release mechanisms have been developed for use with parachutes. For example, U.S. Pat. No. 4,428, 102 issued to Brownell on Jan. 31, 1984 discloses a quick release device, which may be releasably engaged to transmit a tensile force. The '102 Patent incorporates a complex interaction of various parts, rather than a simple innovative design. Similarly, other release mechanisms such as U.S. Pat. No. 4,337,913 issued to Booth on Jul. 6, 1982 and U.S. Pat. No. 4,262,865 issued to Smith on Apr. 21, 1981 do not incorporate the simple yet innovative design of the present invention for use with a rescue tube.

A hook and loop, such as Velcro®, has found many applications and been incorporated into numerous patents. Typical examples of a hook and loop being incorporated into a simple yet novel and nonobvious device are found in U.S. Pat. No. 5,432,955 issued to Plotka et al. on Jul. 18, 1995 and U.S. Pat. No. 5,423,292 issued to Hall on Jul. 13, 1995. However, neither invention referenced nor any other existing device incorporates the simple yet innovative design of the present invention for use with a rescue tube.

SUMMARY OF THE INVENTION

A typical rescue tube is a vinyl, foam-filled, buoyant support. Typically, a tow line and shoulder strap are attached to the support to aid in its use. Attractive features of the typical rescue tube, features maintained in present invention, are its ease of use and multiple person rescue capability. The typical rescue tube can support up to 5 people. A preferred embodiment of the present invention incorporates a buoyant support, a connection strap having a distal end and a proximate end, and a means for attaching the shoulder strap. A functional shoulder strap is formed by looping the distal end and attaching the distal end to the proximate end with a hook and loop fastener, such as Velcro®. Means for disengaging said hook and loop fastener provides a rescuer with the ability to quickly and easily eliminate the dangers associated with a failed rescue attempt.

An object of a preferred embodiment of the present invention is to allow a rescuer to quickly and safely to disengage from a rescue tube while attempting to save a victim.

Another object of a preferred embodiment of the present invention is to provide a simple yet effective release mechanism, which may enable a rescuer to disengage from a dangerous situation.

Another object of a preferred embodiment of the present invention is to provide a rescue tube in which the shoulder strap may be easily adjusted to various sizes to accommodate people of various sizes.

A still further object of a preferred embodiment of the invention is to provide a rescue tube in which a rescuer may quickly disengage from the tube's shoulder strap.

DETAILED DESCRIPTION OF THE INVENTION

Figure 1:
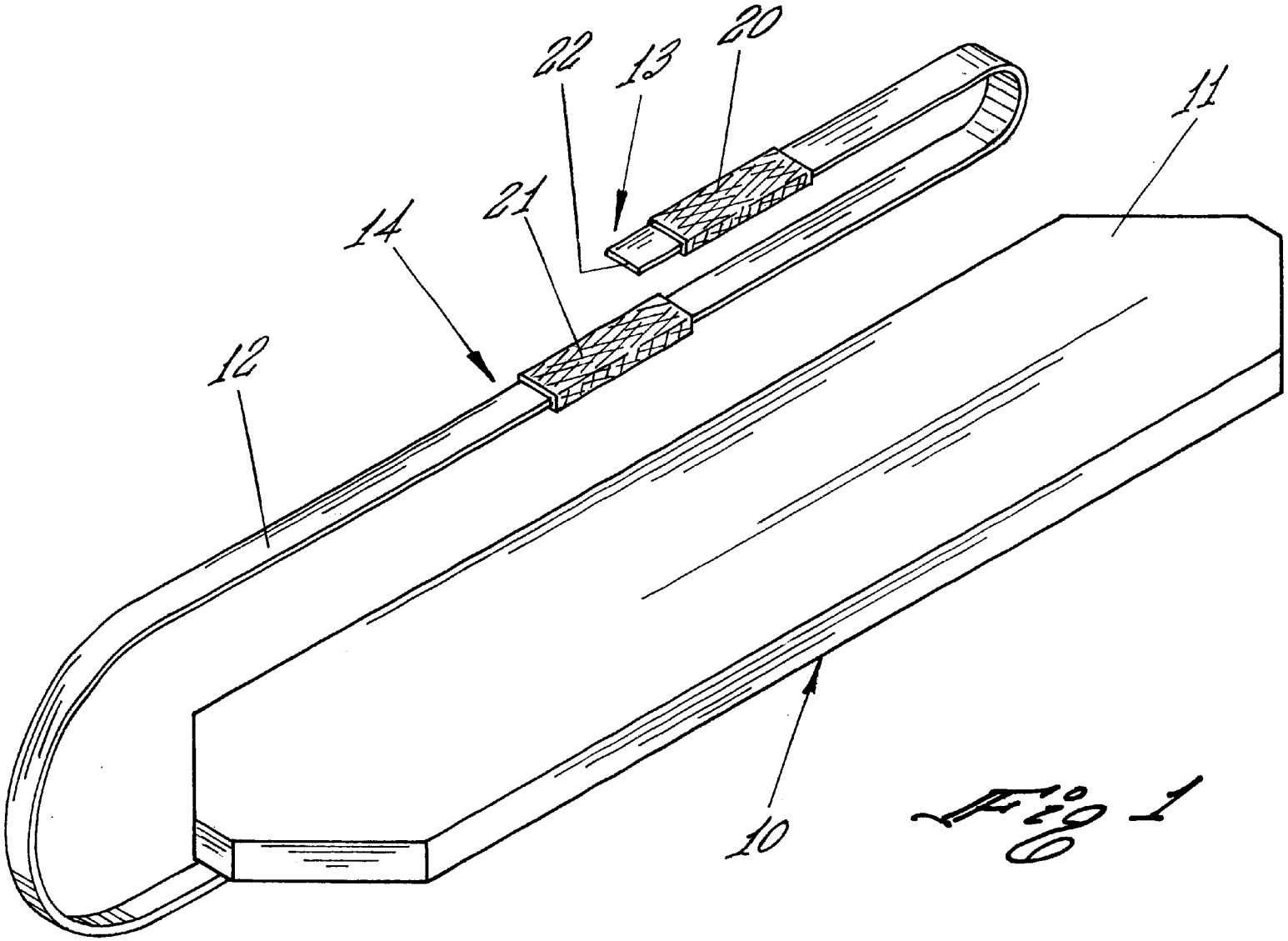
FIG. 1 is an illustration of a preferred embodiment of the rescue tube of the present invention in which quick release mechanism is in a disengaged condition.
Figure 2:
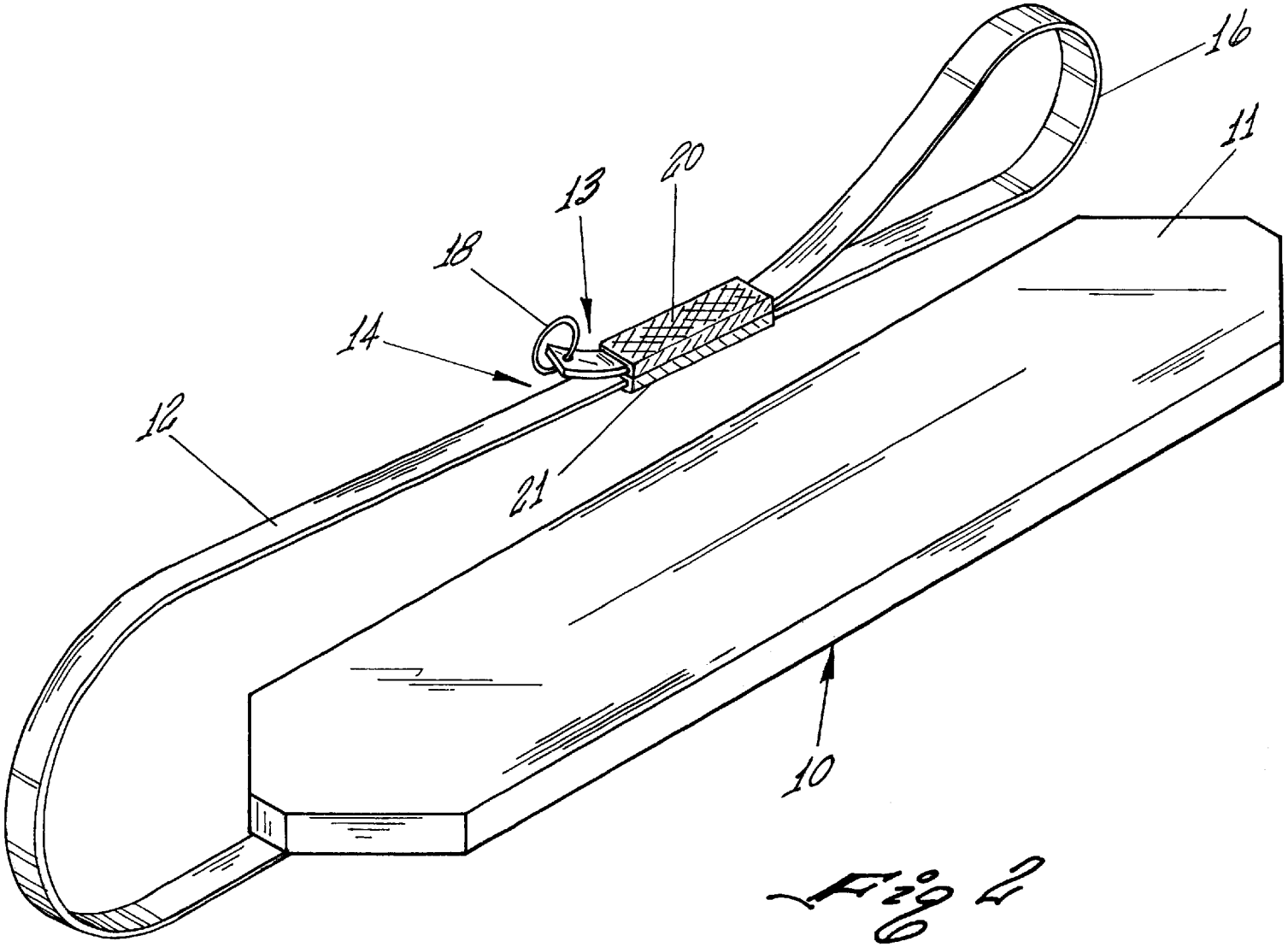
FIG. 2 is an illustration of a preferred embodiment of the rescue tube of the present invention, in which the quick release mechanism is in an engaged condition.
Figure 3:
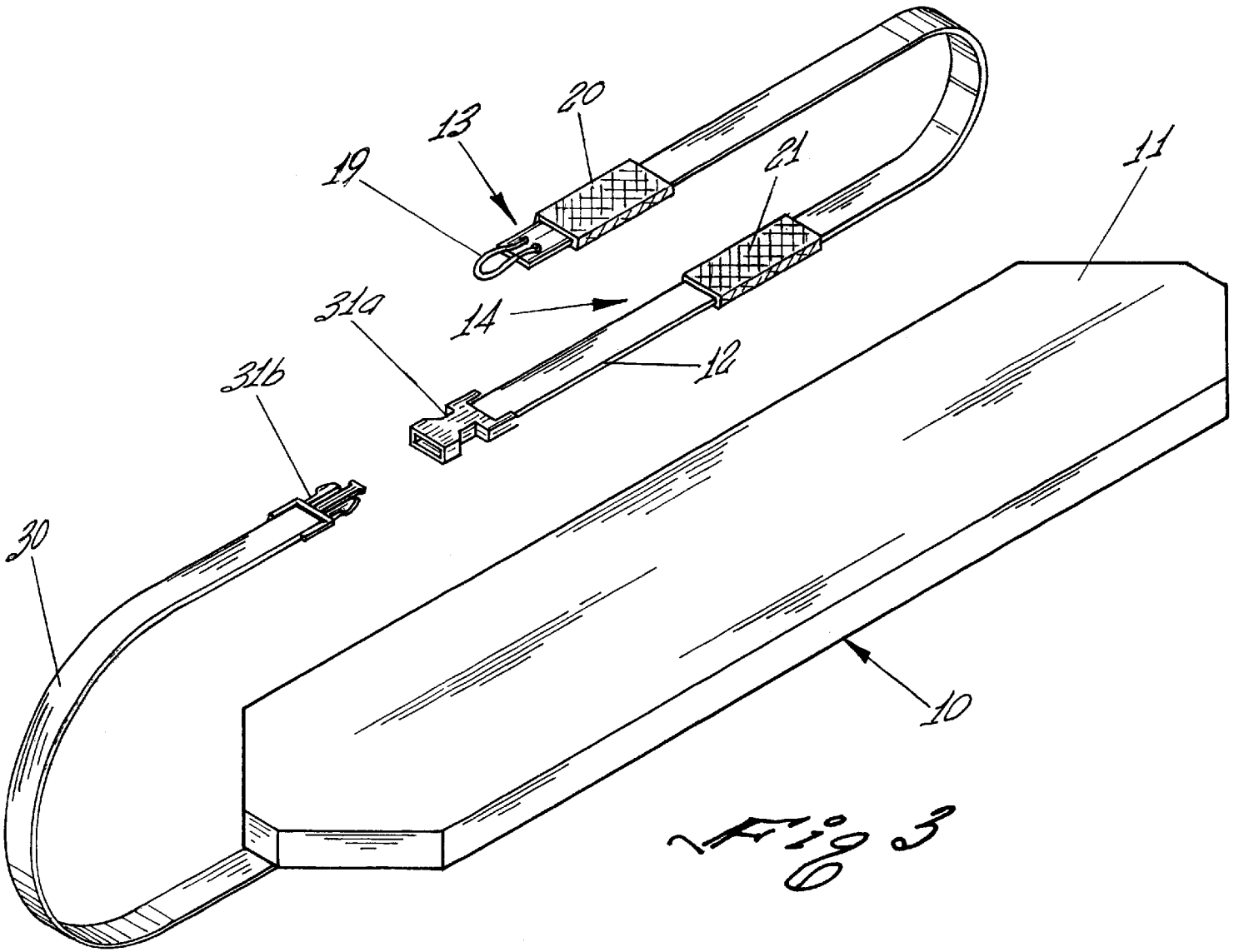
FIG. 3 is an illustration of a preferred embodiment of the rescue tube of the present invention, which incorporates a tow line.

Referring to FIGS. 1 through 3, preferred embodiments of the rescue tube 10 of the present invention are illustrated. A typical rescue tube is a vinyl, foam-filled, buoyant support approximately 45 to 54 inches long. Referring to the National American Red Cross *Lifeguarding Today*, p. 105, incorporated herein by reference, a tow line and shoulder strap are attached to the support to aid in its use. Attractive features of the typical rescue tube, features maintained in present invention, are its ease of use and multiple person rescue capability. The typical rescue tube can support up to 5 people.

A preferred embodiment of the rescue tube 10 of the present invention incorporates a buoyant support 11, a connection strap 12 having a distal end 13 and a proximate end 14, and means for attaching the distal end 13 to the proximate end 14, as illustrated in FIG. 1. In a preferred embodiment of the present invention, the connection strap 12 is between approximately 4 feet to approximately 6 feet in length. A strip of loop material 21 is bonded to the proximate end 14 of the connection strap 12. A strip of hook material 20 is affixed to the distal end 13 of the connection strap 12 removably connecting it to the proximate end 14 of the connection strap 12. In a preferred embodiment of the present invention, the strip of loop material 21 runs ¾ the length of the connection strap 12 from the buoyant support 11. However, the strip of loop material 21 and strip of hook material 20 may be any size capable of effectively maintaining a connection during a rescue attempt. A functional shoulder strap 16 is formed by looping the distal end 13 and attaching the distal end 13 to the proximate end 14 with a hook and loop fastener, such as Velcro®, as illustrated in FIG. 2.

Means for disengaging said hook and loop fastener 20 and 21 provides a rescuer with the ability to quickly and easily eliminate the dangers associated with a failed rescue attempt. FIG. 2 illustrates a preferred embodiment of the present invention where the means for disengaging the hook and loop fastener 20 and 21 is a toggle 18 attached to the distal end 13 of the connection strap 12. In another preferred embodiment of the present invention the distal end 13 of connection strap 12 is devoid of hooks as shown at 22, thereby allowing for a quick and easy grasp of the strip, even by wet hands, for removal as illustrated in FIG. 1. Other means for disengaging the hook and loop fastener 20 and 21 include a nylon or cloth loop sewn into the distal end on the shoulder strap or the distal end sewn into itself producing a loop 19 large enough for a human finger, as illustrated in FIG. 3.

Referring to FIG. 3, a tow line 30 may be added to the rescue tube 10. The tow line 30 is connected to the buoyant support 11 between the buoyant support 11 and the connection strap 12. When a tow line 30 is added, a joiner 31*a*, 31*b* may be included on the buoyant support 11, shown in FIG. 3, and on the connection strap 12. This extends the distance between the buoyant support 11 and the connection strap 12 and removably connects the tow line 30 to the connection strap 12. When the tow line 30 and joiner 31*a*, 31*b* are used, another release point is afforded the rescuer during the rescue attempt, in the event that the quick release mechanism is not accessible.

To operate the rescue tube 10 of the present invention, a rescuer adjusts the connection strap 12 to comfortably fit his or her body forming a shoulder strap 16 when the hook 20 and loop 21 are engaged. When making a rescue attempt, the rescuer is trained to always keep the rescue tube 10 between himself and the victim. When the victim is able to move inside of the tube 10, grab the shoulder strap 16, and then pull up the shoulder strap 16 until the victim is in contact with the rescuer, the rescuer may have extreme difficulty separating from the victim. In that situation, the rescuer cannot easily remove the shoulder strap 16 loop from under his arm. As a result, the rescuer and the victim are at risk of drowning. However, the innovation disclosed in a preferred embodiment of the present invention prevents such a tragedy. In the event of botched rescue attempt, the rescuer may conveniently grasp the loop 19, toggle 18, loose end 22 or any other means for disengaging the hook and loop fastener 20 and 21. At that time, the rescuer pulls the connection strap 12 away from the victim and reconnects the hook and loop fastener 20 and 21 to form a shoulder strap 16 for another rescue attempt.

Although the description above contains many specificities, these should not be construed as limiting the scope of the invention but as merely providing an illustration of the presently preferred embodiment of the invention. Thus the scope of this invention should be determined by the appended claims and their legal equivalents.

What is claimed is:

1. A water rescue device, comprising:

a buoyant support;

a connection strap having a distal end and a proximate end connected to said buoyant support, wherein a shoulder strap is formed by looping the distal end and attaching the distal end to the proximate end with a hook and loop fastener; and means for disengaging said hook and loop fastener.

2. The water rescue device of claim 1, wherein said means for disengaging said hook and loop fastener is a toggle attached to the distal end of said shoulder strap.

3. The water rescue device of claim 2, wherein said toggle is constructed of plastic, nylon or metal.

4. The water rescue device of claim 1, wherein said means for disengaging said hook and loop fastener is a rope line attached to the distal end of said shoulder strap.

5. The water rescue device of claim 1, wherein said means for disengaging said hook and loop fastener is an extension of the distal end of said shoulder strap, wherein said extension forms a hoop, wherein a human finger may enter said hoop.

6. The water rescue tube of claim 1, further comprising a tow line located between said buoyant support and said connection strap, wherein said tow line is removably connected to said connection strap.

7. The water rescue device of claim 6, wherein said means for disengaging said hook and loop fastener is a toggle attached to the distal end of said shoulder strap.

* * * * *